US008733145B1

(12) United States Patent
Chada, Jr. et al.

(10) Patent No.: US 8,733,145 B1
(45) Date of Patent: May 27, 2014

(54) METHOD OF FORMING A POLE AND SADDLE

(75) Inventors: Robert L. Chada, Jr., Broken Arrow, OK (US); Richard Schiller, Yale, OK (US); Tony Schuler, Hominy, OK (US)

(73) Assignee: Valmont Newmark, Inc., Omaha, NE (US)

( * ) Notice: Subject to any disclaimer, the term of this patent is extended or adjusted under 35 U.S.C. 154(b) by 699 days.

(21) Appl. No.: 13/013,121

(22) Filed: Jan. 25, 2011

(51) Int. Cl.
*B21C 37/08* (2006.01)
*B21D 31/00* (2006.01)

(52) U.S. Cl.
USPC ..... 72/368; 72/363

(58) Field of Classification Search
USPC ..... 72/363, 369, 389.1–389.4, 713, 465.1, 72/467–469, 473, 477, 478; 29/33 B
See application file for complete search history.

(56) References Cited

U.S. PATENT DOCUMENTS 6,509,541 B2 * 1/2003 Jung et al. ..... 219/91.2

* cited by examiner

*Primary Examiner* — Debra Sullivan
(74) *Attorney, Agent, or Firm* — Camoriano and Associates

(57) ABSTRACT

A method and apparatus for forming a pole with a wrap-around saddle includes making corresponding bends in the pole and saddle in the same motion.

6 Claims, 6 Drawing Sheets

METHOD OF FORMING A POLE AND SADDLE

BACKGROUND

The present invention relates to a method of forming a pole with a saddle. It is common practice to bend a metal pole and then bend a metal saddle that wraps around the pole and is welded to the pole and extends for a few feet above and below ground level to provide additional thickness to help resist corrosion of the pole. The saddle is substantially shorter than the full length of the pole. For example, the saddle may extend three feet below ground level and three feet above ground level, while the pole may extend ten feet below ground level and 35 feet above ground level.

It is important for the saddle to fit the contour of the pole very closely so the saddle and pole function together, with a good, sealed weld that will not leak or allow moisture between the saddle and the pole. Fitting the saddle to the pole can be a very difficult, costly, and time-consuming process, requiring a skilled craftsman. Even then, the saddle may not fit snugly enough against the pole to perform its intended function.

BRIEF SUMMARY

As described below, in a preferred embodiment of the present invention, the saddle and pole are formed together, with the bending machine simultaneously applying force to both sheets of metal to form a set of mating bends in the saddle and pole. This process is repeated as many times as needed to make as many sets of mating bends as needed to form the pole and saddle. The pole may be made of more than one elongated pole segment, with each segment forming part of the circumference of the pole. For example, there may be two pole segments, each of which extends 180 degrees. In that case, there also would be two saddle segments. The longitudinal side edges of the pole segments and saddle segments are then aligned and welded together to form the complete tubular pole with a complete tubular wrap-around saddle. The top and bottom edges of the saddle are then welded to the pole to complete the seal and prevent moisture and contaminants from entering between the saddle and pole.

Since the saddle and pole are formed together, the result is a good, snug fit between the saddle and the pole, which permits the saddle to perform its intended function very effectively. This arrangement also eliminates the need for extensive fitting by a skilled craftsman and the need for hand-welding of the longitudinal seams of the saddle. Instead, the longitudinal seam of the pole and of the saddle can be performed by an automated welding machine, which simply travels along the entire seam. The machine travels more slowly in the area of the saddle in order to lay down more material to fill the deeper seam in that area and then travels more quickly in the area in which it is only welding the pole.

DETAILED DESCRIPTION

Figure 1:
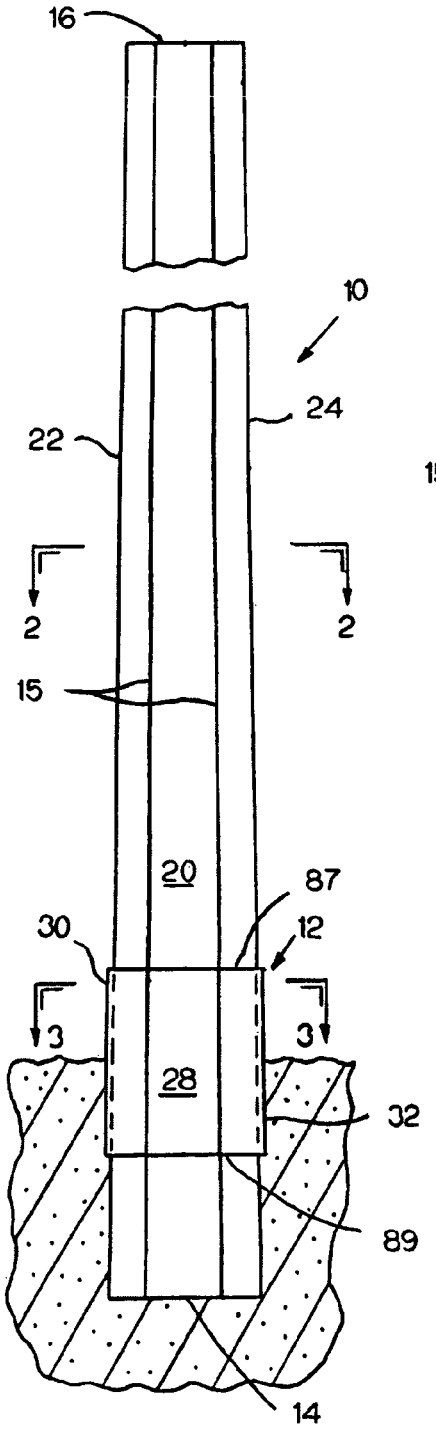
FIG. 1 is a side view of a pole and saddle made in accordance with the present invention and extending into the ground, which is shown in section.
Figure 2:
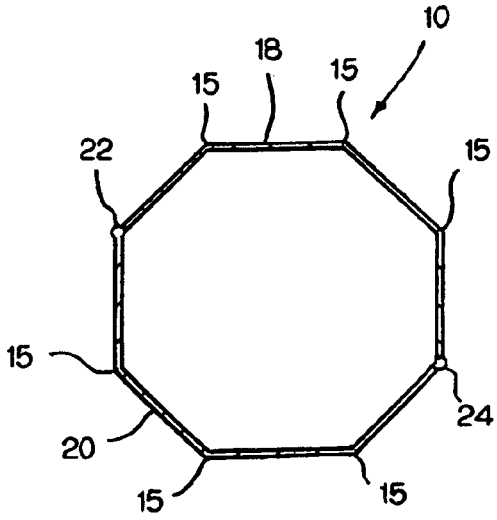
FIG. 2 is a section view along line 2-2 of FIG. 1.
Figure 3:
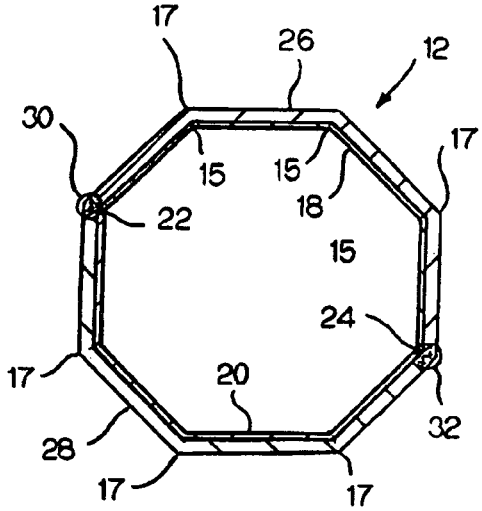
FIG. 3 is a section view along line 3-3 of FIG. 1.

FIGS. 1-3 show a metal pole 10 with a wrap-around saddle 12. This particular pole is tapered from a larger diameter base 14 to a smaller diameter top end 16. The cross-sectional profile of this pole 10 is octagonal. Of course, the pole may have more or fewer than the eight sides of this pole. For example, it may be six-sided or twelve-sided.

Figure 2A:
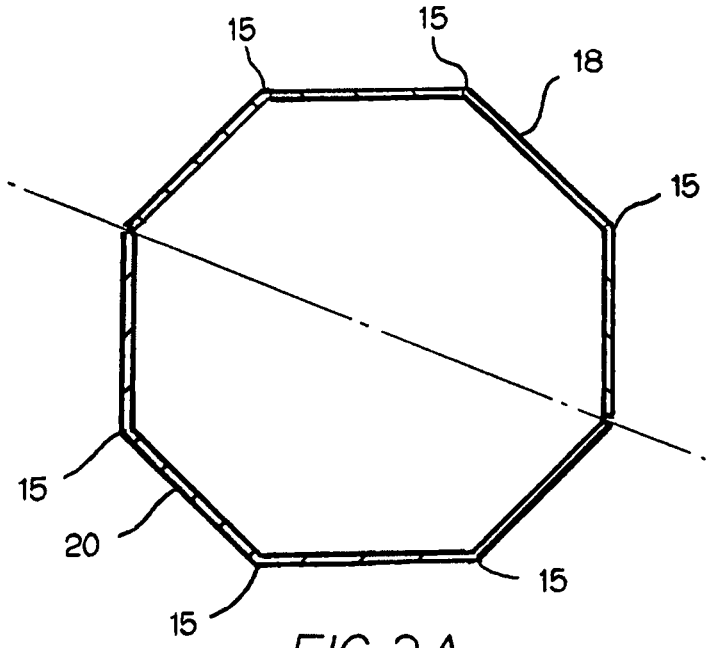
FIG. 2A is the same view as FIG. 2, but before the pole segments have been welded together.
Figure 3A:
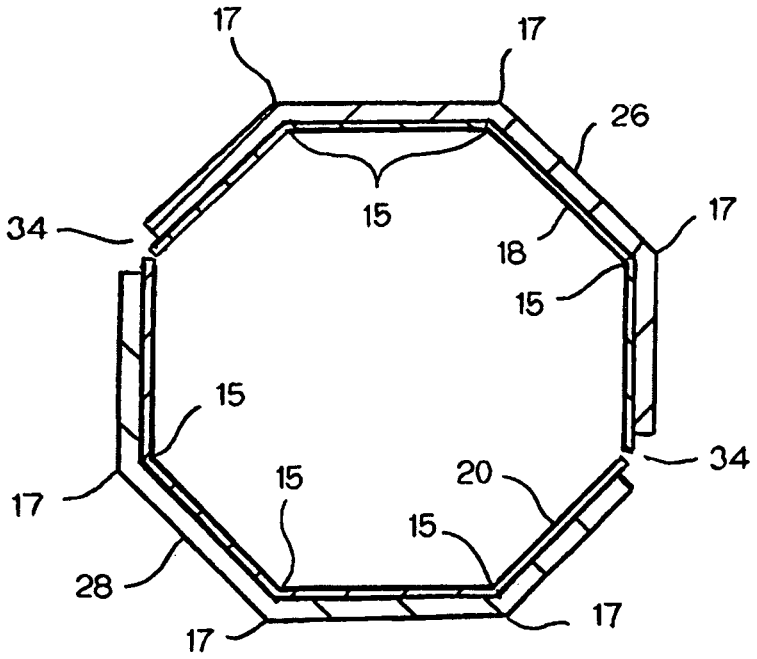
FIG. 3A is the same view as FIG. 3, but before the saddle and pole segments have been welded together.

This particular pole 10 is made in two longitudinal segments 18, 20, as shown in FIG. 2A. The side edges of those longitudinal segments are aligned and welded together to form the seams 22, 24 shown in FIG. 2. The saddle 12 is also made in two longitudinally-extending segments 26, 28, as shown in FIG. 3A. The side edges of those longitudinal segments are aligned and welded together to form the seams 30, 32 shown in FIG. 3. Of course, the number of longitudinally-extending segments could be different, as desired, with each longitudinal segment forming a portion of the circumference of the pole. Then the process would include making the number of longitudinal seams as needed to complete the full circumference of the pole.

As was explained above, the respective pole segment 18 and saddle segment 26 are formed together, using a bending machine that applies force simultaneously to two adjacent sheets of metal to form mating bends 15, 17 in the two sheets—one sheet being formed into the pole segment 18 and the other sheet being formed into the saddle segment 26. This ensures that the saddle segment 26 is snugly fitted to the pole segment 18, with minimal gaps. In this particular embodiment, there are three longitudinal bends 15 in each of the pole segments 18, 20 and three mating longitudinal bends 17 in each of the saddle segments 26, 28.

Figure 9:
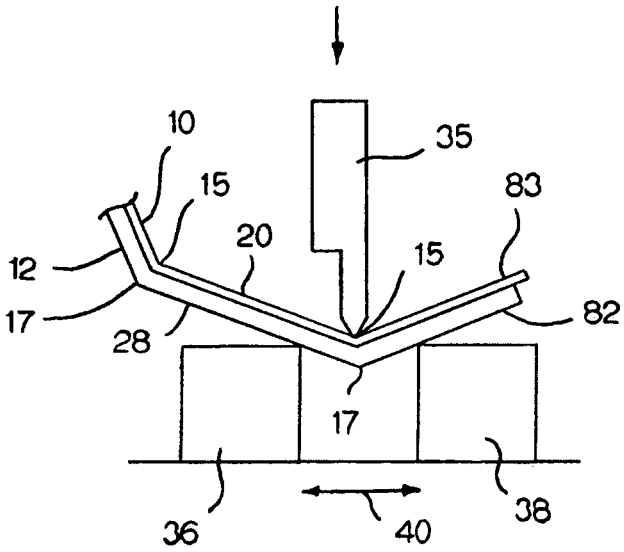
FIG. 9 is an end view showing a press brake simultaneously making bends in the saddle and pole.

FIGS. 4-9 schematically illustrate a method of simultaneously bending the mating bends 15, 17 in the pole segment 20 and saddle segment 28, respectively, using a press brake type of bending machine. FIG. 9 shows the upper beam 35 of the press brake moving downwardly and applying a downward force to the metal sheets, which are supported by spaced-apart lower die bars 36, 38, to simultaneously form mating bends 15, 17. The bottom table of the press brake, which supports the die bars 36, 38, is omitted for clarity.

Special die bars 36, 38 are used to permit both sheets to be bent together. Only one die bar 36 is described below, with the understanding that both die bars 36, 38 are modified in the same way.

Figure 4:
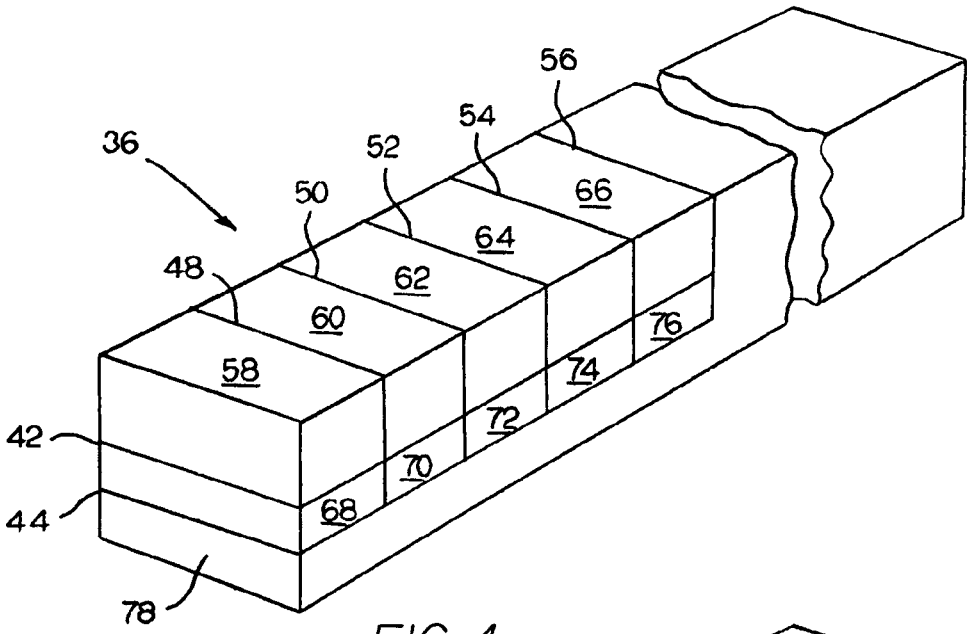
FIG. 4 is a schematic perspective view of a lower die bar after it has been modified to accommodate a saddle.
Figure 5:
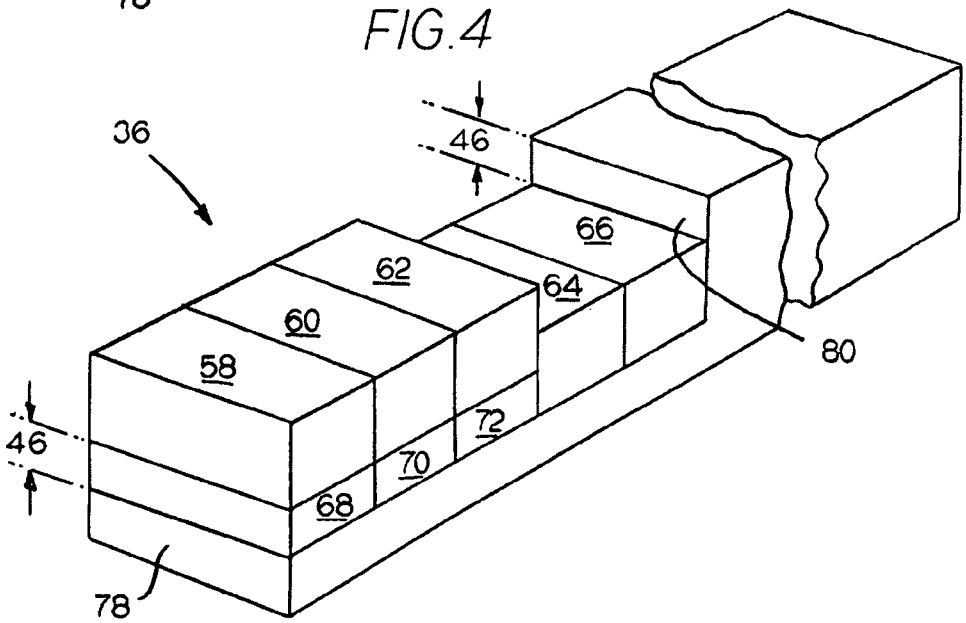
FIG. 5 is a schematic perspective view of the die bar of FIG. 4 after it has been set up to receive a saddle.

Referring now to FIGS. 4 and 5, the die bar 36 is a metal rail, rectangular in cross-section and long enough to support the entire length of metal pole to be bent, which may be 20 feet or even longer. The upper beam 35 is the same length as the die bar 36. In a preferred embodiment, three die bar segments are laid end-to-end to make up one of the lower die bars 36, and these are all bolted down with through bolts (not shown) to the table of the press brake. The die bar segment that forms the lower end of the pole is specially made in order to enable it to be adjustable, as described below, while the other die bar segments preferably are just a solid piece of metal having a rectangular cross-section. The die bars 36, 38 also can be adjusted laterally on the table in order to adjust the size of the bottom die opening 40 (See FIGS. 6 and 9).

Referring to FIG. 4, to make the segment of the die bar 36, two parallel, horizontal cuts 42, 44 are made to the die bar 36. These cuts extend from the front end of the die bar 36 rearwardly for a distance that represents the maximum distance from the bottom edge of the pole segment to the top edge of the saddle for any combination of pole and saddle that is to be formed using this die bar 36.

After the two horizontal cuts 42, 44 are completed, a plurality of vertical cuts 48, 50, 52, 54, 56 are made, going through the upper horizontal cut 42 and extending to the lower horizontal cut 44. In a preferred embodiment, the vertical cuts 48-56 are made at regular intervals, such as every 12 inches. This creates a plurality of die caps 58, 60, 62, 64, 66, and a plurality of spacers 68, 70, 72, 74, 76. These may all be bolted down through the die base 78 and onto the table of the press brake. The vertical distance between the horizontal cuts 42, 44 is the same as the thickness of the metal sheet to be used to form the saddle. In this particular embodiment, that distance is 3/16".

FIG. 5 shows how the die bar 36 is adjusted to accommodate the metal sheet 82 to form the saddle segment 28 so it can be bent simultaneously with the pole segment 20 on the press brake. The spacers 74, 76 are removed and the die caps 64, 66 are bolted directly onto the die base 78. If the vertical cuts 48, 50, 52, 54, 56 are spaced at twelve-inch intervals, this adjustment results in a valley 80 in the top surface of the die bar 36. The valley 80 is 24 inches long and 3/16" deep and begins three feet from the front end of the die bar 36. The appropriate spacers are removed at the appropriate positions to provide a valley 80 that is located in the proper position to receive the metal sheet 82 that will form the saddle segment 28.

Figure 6:
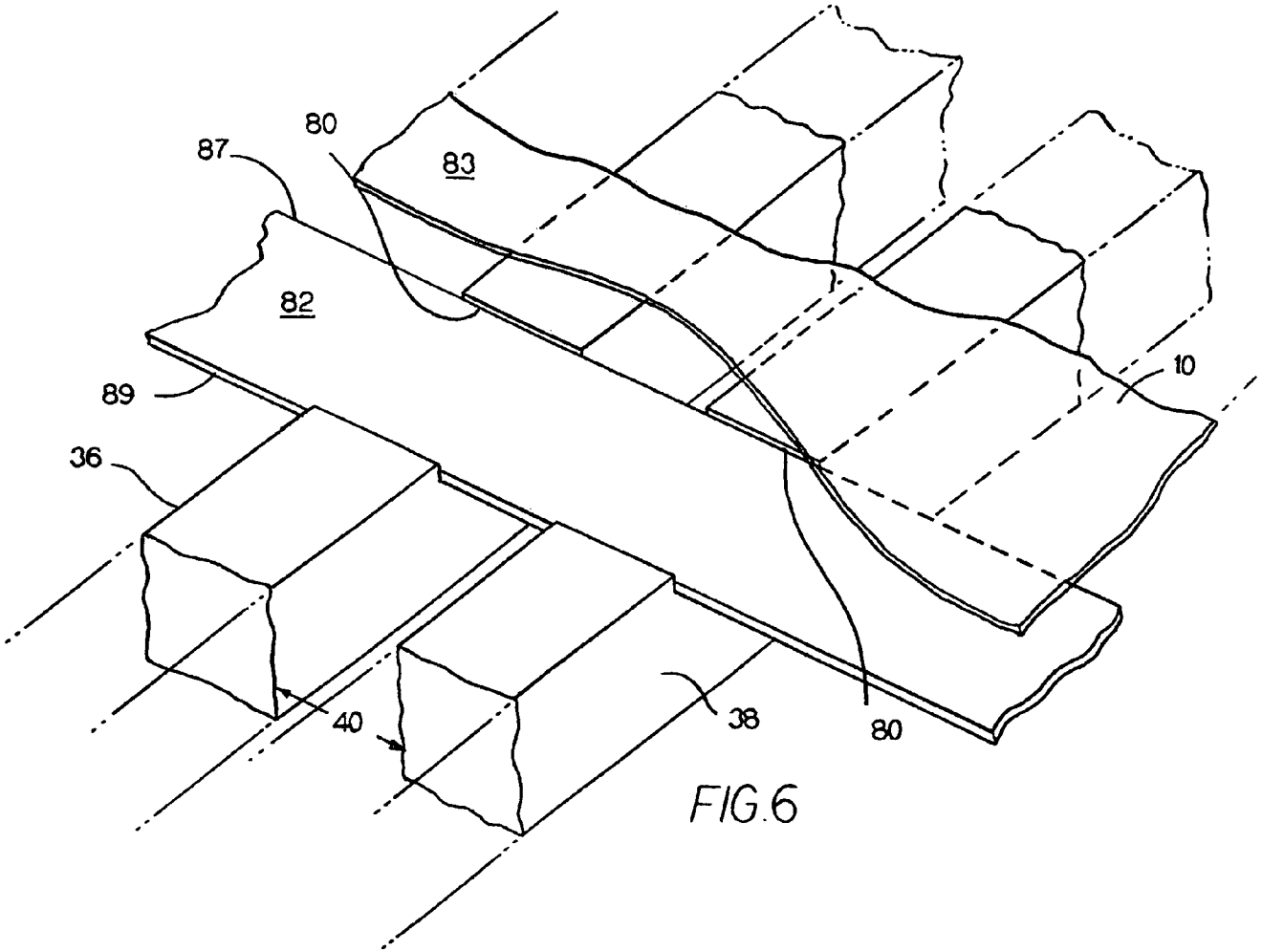
FIG. 6 is a broken away, schematic, perspective view of two die bars, a saddle, and a pole just before they are bent by a press brake.
Figure 7:
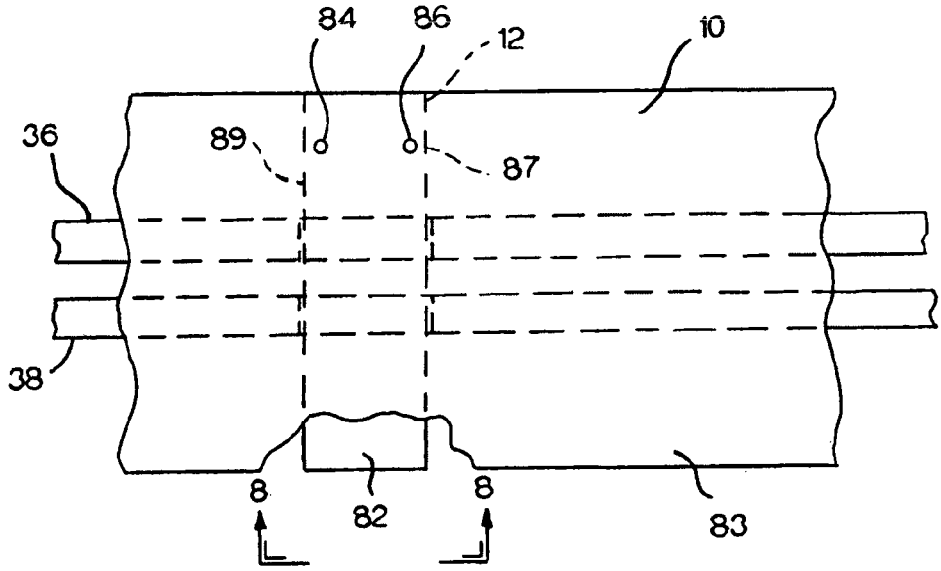
FIG. 7 is a plan view of the arrangement of FIG. 6.
Figure 8:
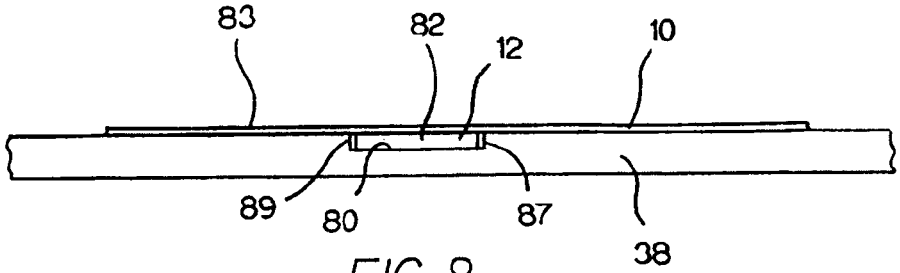
FIG. 8 is a view along line 8-8 of FIG. 7.

FIG. 6 is a broken away, perspective view showing the two die bars 36, 38 with the flat sheet of metal 82 which is to be bent into the saddle segment 20 located within the aligned valleys 80 of the parallel die bars 36, 38. It may be appreciated that the flat metal sheet 82 to be used to form the saddle segment 20 rests on the top surface of the die caps that form the valley 80, and the top surface of the sheet 82 is flush with the normal top surface of the die bars 36, 38 (which is the top surface of the other die caps 58, 60, 62). The flat metal sheet 83 that will form the pole segment 20 is placed over the die bars 36, 38 and overlies the sheet 82 that will form the saddle segment 28.

To ensure that the saddle segment 28 will be in the correct location relative to the pole segment 20, two through openings 84, 86 (See FIG. 7) are made in the overlying sheet 83 just inside the desired positions for the top and bottom edges 87, 89 of the underlying sheet 82. Preferably, the two through openings 84, 86 are substantially axially aligned with each other. This enables the operator to check to make sure the underlying sheet 82 for the saddle segment 28 is properly located relative to the overlying sheet 83 before making the elongated mating bends 15, 17. For instance, if the saddle 12 is two feet long, the two through openings 84, 86 may be 22 or 23 inches apart from each other in the axial (longitudinal) direction.

When the operator visually confirms that the overlying sheet 83 and underlying sheet 82 are properly positioned relative to each other, he may weld the two sheets together through both of the through openings 84, 86 to ensure that they remain together and remain properly aligned throughout the bending process and then throughout the process of welding the seams. This weld may be a seal weld or a tack weld. It will be noted that the widths of the underlying sheet 82 and overlying sheet 83 are the same and their respective longitudinal edges are aligned with each other. The lengths of the underlying sheet 82 and overlying sheet 83 are substantially different, with the sheet 82 that forms the saddle segment 28 being much shorter than the sheet 83 that forms the pole segment 20.

As indicated earlier, the two longitudinal "half poles" 18, 20 are thus formed together with their corresponding half saddles 26, 28. Each mating set of bends 15, 17 is made simultaneously as the upper beam 35 presses downwardly on the sheets 83, 82 while the die bars 36, 38 provide an upward force on the sheets 83, 82, as shown in FIG. 9. The metal sheets 82, 83 are then shifted laterally the desired distance to align them with the upper beam 35 to make the next bend, and so forth, until all the mating pairs of bends 15, 17 are made to form the mated pole segment 20 and saddle segment 28. This process is repeated for the other pole segment 18 and saddle segment 26. Since the mated pole and saddle segments are formed together at the same time, they fit together perfectly without the need for special, time-consuming fitting.

Once the mated segments have been formed, the elongated edges of the pole segments 18, 20 and saddle segments 26, 28 are brought into alignment as shown in FIG. 3A, and the elongated seams are welded using an automated welding machine. The welding machine travels along the seam at a varying speed, travelling more quickly where it is only making the welds 22, 24 on the pole 10 and more slowly where it is also making the welds 30, 32 on the saddle 12, which enables it to lay in more weld material to fill the entire seam in the saddle area. In this manner, it is able to complete an entire longitudinal seam of both the pole and saddle in just a single pass.

Once the elongated vertical seams are welded, the top and bottom edges 87, 89 of the saddle 12 are welded to the pole 10. So far, this has been accomplished by hand welding. However, the process could be automated if desired. The result is a saddle which is snugly fitted to a pole and with welds that seal the saddle and pole together to prevent contaminants from entering between them.

It will be obvious to those skilled in the art that modifications may be made to the method and product described above without departing from the scope of the present invention as claimed.

What is claimed is:

1. A method of making a pole, comprising the steps of:

placing first and second metal sheets on a pair of spaced-apart die bars of a bending device, each of said first and second metal sheets having a thickness, with one of said first and second metal sheets overlying the other, such that the other is an underlying sheet, wherein each of said sheets has a width dimension and a length dimension, wherein the width dimensions of said first and second metal sheets are substantially equal, and wherein the length dimension of one of said first and second metal sheets is substantially longer than the length dimension of the other of said first and second metal sheets;

wherein said die bars are at least as long as the longer of the first and second metal sheets, and wherein each of said die bars defines a valley which has the thickness of the other of said first and second metal sheets and which receives the other of said first and second metal sheets along the full length dimension of the other of said first and second metal sheets; and then using said bending device to apply force to both said first and second sheets at the same time between the spaced-apart die bars, thereby causing the overlying and underlying metal sheets to form a set of mating bends, and repeating the simultaneous application of force to both sheets as needed to make as many sets of mating bends as needed to form a first elongated pole segment and a first saddle segment snugly wrapping around the outside of said first elongated pole segment, each of said first pole segment and first saddle segment having first and second elongated lengthwise edges and top and bottom edges; and welding along the elongated lengthwise edges of the first elongated pole segment and of the first saddle segment and welding the top and bottom edges of the first saddle segment to the first elongated pole segment.

2. A method of making a pole as recited in claim 1, and further comprising the steps of:

placing third and fourth metal sheets on a bending device, with one of said third and fourth metal sheets overlying the other, such that the other is an underlying sheet, wherein each of said third and fourth sheets has a width dimension and a length dimension, wherein the width dimensions of said third and fourth metal sheets are substantially equal, and wherein the length dimension of one of said third and fourth metal sheets is substantially longer than the length dimension of the other of said third and fourth metal sheets; and then using said bending device to simultaneously apply force to the third and fourth metal sheets to form a pair of mating bends in both the third and fourth metal sheets, and repeating the simultaneous application of force to the third and fourth metal sheets as many times as needed to make as many sets of mating bends as needed to form a second elongated pole segment and a second saddle segment snugly wrapping around the outside of said second elongated pole segment, each of said second pole segment and second saddle segment having first and second elongated lengthwise edges and top and bottom edges; and aligning the first elongated edge of said second elongated pole segment with the first elongated edge of the second saddle segment and with the second elongated edges of said first elongated pole segment and first saddle segment; and welding the respective aligned elongated edges together and welding the top and bottom edges of the second saddle segment to the second pole segment.

3. A method of forming a pole as recited in claim 2, wherein each of said first and second pole segments forms half of the pole and each of said first and second saddle segments forms half of the saddle, and wherein the method further includes aligning the second elongated edge of the second elongated pole segment with the second elongated edge of the second saddle segment and with the first elongated edges of the first elongated pole segment and first saddle segment; and welding those respective aligned elongated edges together.

4. A method of making a pole as recited in claim 1, wherein each overlying sheet defines at least one through opening which allows an operator to observe the location of the respective underlying sheet by looking through that opening.

5. A method of making a pole as recited in claim 2, wherein the step of welding along the first elongated lengthwise edges of said first and second elongated pole segments and said first and second saddle segments includes using an automated welding apparatus, which travels more slowly in the area in which both the pole segment and the saddle segment are being welded and travels more quickly in the area beyond the saddle segment where only the pole segment is being welded.

6. A method of making a pole as recited in claim 1, wherein said die bars include a die base; a plurality of die caps; and a plurality of spacers between the die base and the die caps, with the spacers having a thickness which is the same as the thickness of the other of the first and second metal sheets; and wherein the method includes forming the valley by removing the spacers in an area of the die bars which is at least as long as the length of the other of said first and second metal sheets.

* * * * *